US005138715A

United States Patent [19]

Baustin

[11] Patent Number: 5,138,715

[45] Date of Patent: Aug. 18, 1992

[54] PORTABLE SANITARY GARMENT

[76] Inventor: Michel M. Baustin, 1066 E. 81st St., Brooklyn, N.Y. 11236

[21] Appl. No.: 735,862

[22] Filed: Jul. 25, 1991

[51] Int. Cl.[5] ..... A41D 1/00

[52] U.S. Cl. ..... 2/96; 2/93; 2/85; 2/247

[58] Field of Search ..... 2/96, 93, 94, 85, 101, 2/247; 128/77; 623/57

[56] References Cited

U.S. PATENT DOCUMENTS 2,711,539 6/1955 Loscher ..... 2/93
3,102,570 9/1963 Fairchilds ..... 2/96

*Primary Examiner*—Werner H. Schroeder
*Assistant Examiner*—Gloria Hale

[57] ABSTRACT

A cloak-like garment having artificial sleeves and hands provided thereon so that when the garment is worn by a person having his arms and hands inside the garment there is an illusion of a person wearing a conventional sleeved garment with his arms and hands outside the body of the garment.

6 Claims, 1 Drawing Sheet

PORTABLE SANITARY GARMENT

FIELD OF THE INVENTION

This invention relates to a sanitary garment and more particularly to a garment that, in the absence of an available public toilet or restroom, can be worn by a person as an outer garment and used in a sanitary fashion and inconspiculously when a man is confronted with the need to relieve himself.

BACKGROUND OF THE INVENTION

The scarcity of public toilets or restrooms has caused a great deal of discomfort and annoyance to countless people who need the convenience of such facilities. This is especially true in urban areas. The civic problem created by such scarcity and the public nuisance resulting therefrom has been exacerbated by the fact that even among those public toilets provided in subway stations and parks many have been closed because of vandalism and misuse. The consequences of this situation is an increasing incidence of public urination with its accompanying demeaning of city life.

This overall problem has led to increasing demands for the installation of sidewalk toilet booths of the type that are presently being installed in Paris and London by their British manufacturer, Street Equipment, Ltd, as well as other measures to overcome the problem.

The sanitary garment provided by the invention is suitable for men who experience difficulty in bladder control, or who frequently travel in busy areas that lack "comfort" facilities, and especially for older men who have medical problems or who are taking medications such as diuretics, and who are sensitive to the problems heretofore mentioned.

Applicant is unaware of any prior art relating to the subject matter of the invention. However, the following statement was noted in a New York Times editorial on Nov. 5, 1990 calling for the provision of sidewalk toilet booths, "By the 18th century, some European cities were reduced to reliance on street vendors who offered the use of buckets and the privacy of a voluminous cloak" Because of the antiquity of the arrangement referred to and the absence of any intervening improvements, applicant does not believe that the use of a bucket and voluminous cloak is pertinent prior art so far as his invention is concerned.

GENERAL DESCRIPTION OF THE INVENTION

It is the object of the invention to provide a garment that when worn by a person enables that person to relieve himself in private and inconspicuously when in a generally public ambience.

It is another object of the invention to provide a cloak-like garment that when worn by a person gives the appearance of that person wearing a conventional outer garment with sleeves and with his hands by his side outside the garment.

In carrying out the invention, a front opening cloak-like garment is provided with simulated sleeves and projecting hands so that when worn by a person whose own arms and hands are within the garment it appears that the person is wearing a coat and is standing with his hands at his sides outside the garment. The garment is also provided with a zipper or other means for closing the front opening that can be manipulated from within the garment, and with an internal pocket for holding or storing a suitable container that is used to collect urine.

The garment provided by this invention is not to be considered as a conventional garment or article of clothing to be worn generally but rather as an accessory, such as an umbrella, to be used under special circumstances.

Features and advantages of the invention may be gained from the foregoing and from the description of a preferred embodiment thereof which follows.

DETAILED DESCRIPTION OF THE INVENTION

Figure 1:
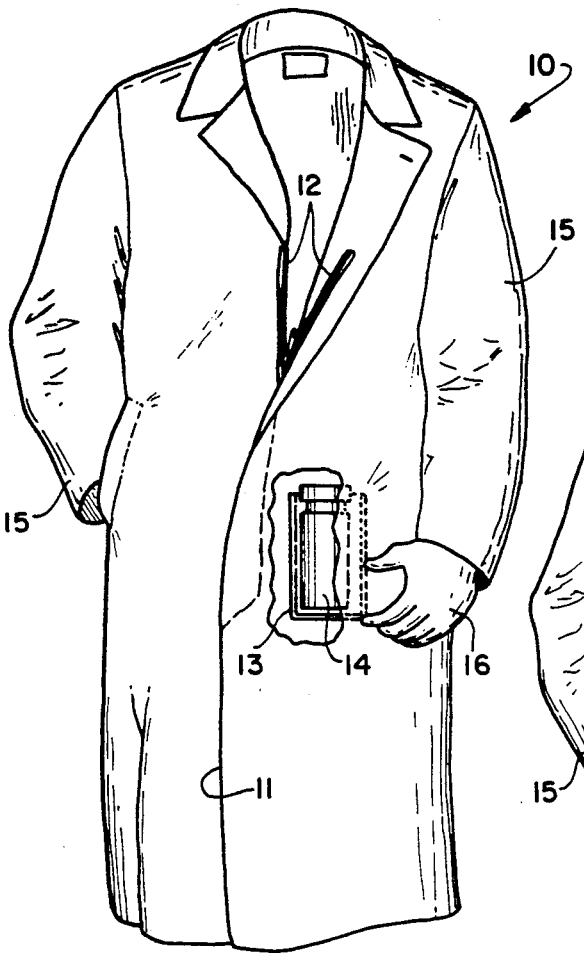
FIG. 1 is an illustration of the garment-like enclosure of the invention.

Referring to FIG. 1, a cloak-like garment 10 is shown having a front opening 11 that enables the garment to be worn like an outer coat by a person. The garment is of a length of a raincoat or topcoat and is made of a fabric generally used for such garments. A zipper 12, or other suitable means such as a Velcro closure, is provided so that after garment 10 is donned by a person the front opening 11 can be closed from within the garment.

An internal pocket 13 is provided for storing a closable container 14 that is suitable for collecting urine and holding it without possibility of spillage for later disposal in a proper manner.

The garment 10 is tailored to fit a person like a conventional outer coat and is also provided with artificial sleeves 15 and hands 16 so that when worn by a person, the garment will simulate that person wearing a conventional raincoat or topcoat with his arms within the sleeves of the coat and his hands projecting therefrom. Sleeves 15 and hands 16 may be actual appendages to the garment 10. That is sleeves 15 may be actual sleeves or pieces of fabric resembling sleeves sewn onto garment 10 and hands 16 will be flesh colored simulated hands, made of fabric or other suitable material, sewn to sleeves 15. The hands 16 may be placed in a pocket provided in garment 10 or at the side of the garment, as shown, or they might be placed nearer the front opening 11 of the garment. They may be held in place by stitching them to the body of garment 10. Also, if garment 10 is to simulate a person with a hand in a pocket, the simulated hand may be omitted and the end of the sleeve stitched to that pocket. Sleeves 15 and hands 16 of garment 10 may be trompe l'oeil decorations that are designed to make a viewer think the objects represented are real. Thus, garment 10 can be painted, embroidered, or otherwise ornamented to give the illusion of sleeves with protruding hands. When garment 10 is donned by a person, the effect is of a person wearing a raincoat or the like with his arms outside the garment, thus making a person using garment 10 as inconspicuous as possible.

Figure 2:
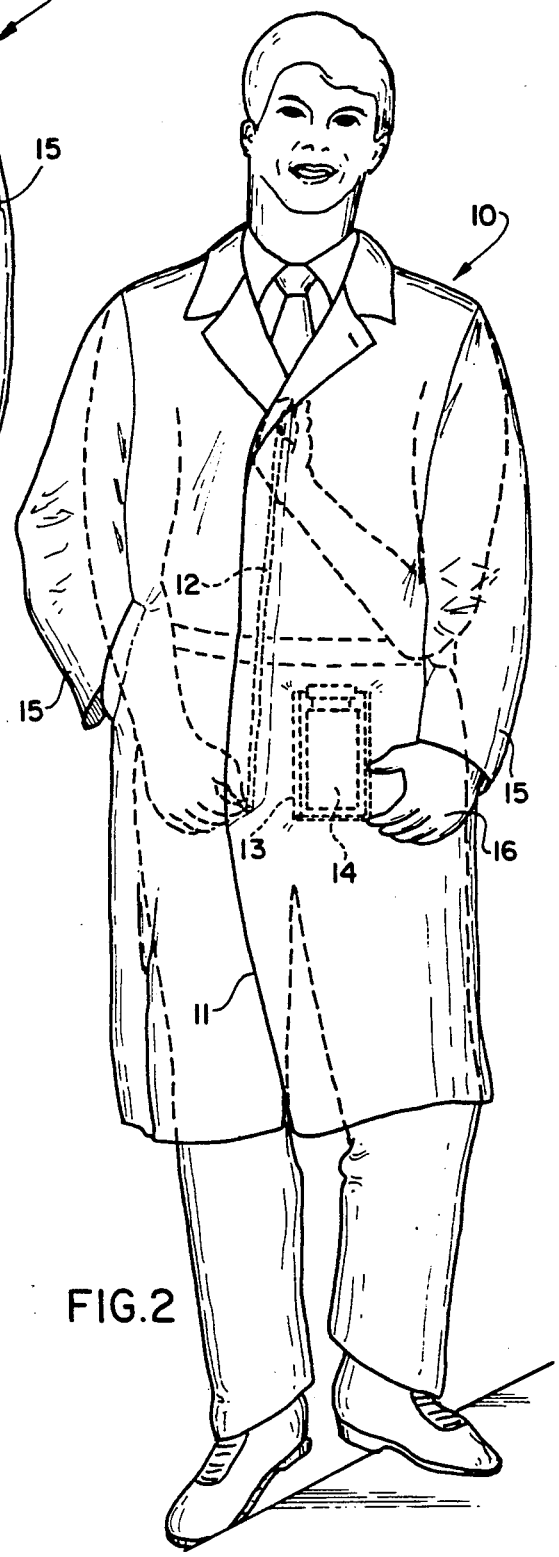
FIG. 2 is an illustration of the enclosure in use.

FIG. 2 illustrates a person using garment 10. Within the garment the person is shown in dotted outline.

In use, garment 10 would be carried by a man who experiences difficulty in bladder control or who travels in busy areas that lack "comfort" facilities, and those who are taking medications that cause frequent urination. When the need for relief arises, and no public toilet or restroom or other facility is available, he can proceed to an inconspicuous place, don garment 10, and relieve himself in private without becoming a public nuisance. To any observer who is not too proximate, the garment 10 would cause the user thereof to be seen simply as a pedestrian standing observing the passing scene or observing something that might attract the attention of a pedestrian. Thus, use of garment 10 would be inconspicuous as compared to the use of a "voluminous cloak" of the type referred to in the aforementioned editorial.

Having thus described the invention it is apparent that the tromp l'oeil design or decoration or appendages on the garment may be enhanced to appear to show the carrying of a briefcase, or a newspaper, or any other small article. Or the arms and hands may appear to be in a position other than at a person's side, e.g., crisscrossed at the person's chest. Therefore, it is intended that the foregoing description and the accompanying drawing be interpreted as illustrative rather than in a limiting sense.

What is claimed is:

1. A cloak-like garment having simulated sleeves and at least one simulated hand projecting from the end of one sleeve, said garment being provided with a front opening that enables the garment to be donned by a person like an outer coat but with his arms and hands inside said garment, and closure means attached to said opening that can be manipulated to close said front opening from within said garment, the arrangement being such that when the garment is worn by a person with his arms and hands inside the garment there is an illusion of a person wearing a conventional sleeved garment with at least one hand visible outside the garment.

2. A garment according to claim 1 wherein said garment includes an internal pocket.

3. The combination of a garment according to claim 2 together with a closable liquid container that is stored in said pocket.

4. A garment according to claim 1 wherein the simulated sleeves and hand are tromp l'oeil markings on the surface of said garment that appear to be sleeves and a hand when viewed from a distance.

5. A garment according to claim 4 wherein said tromp l'oeil markings are painted on said garment.

6. A garment according to claim 4 wherein said tromp l'oeil markings are embroidered on said garment.

* * * * *